US007401482B1

(12) United States Patent
Shaw et al.

(10) Patent No.: US 7,401,482 B1
(45) Date of Patent: Jul. 22, 2008

(54) PORTABLE LOCKER APPARATUS

(75) Inventors: Richard J. Shaw, Pewaukee, WI (US); Kenneth R. McCallum, deceased, late of Campbellsport WI (US); by Jeffrey S. McCallum, legal representative, Campbellsport, WI (US)

(73) Assignee: Innovation Creation Inc., Hartford, WI (US)

( * ) Notice: Subject to any disclaimer, the term of this patent is extended or adjusted under 35 U.S.C. 154(b) by 0 days.

(21) Appl. No.: 11/717,552

(22) Filed: Mar. 14, 2007

Related U.S. Application Data

(60) Provisional application No. 60/817,162, filed on Jun. 29, 2006.

(51) Int. Cl.
*B65D 55/14* (2006.01)

(52) U.S. Cl. ..... 70/63; 109/45; 62/457.4; 206/139

(58) Field of Classification Search ..... 70/63; 109/45, 52, 53; 211/59.2; 206/139, 203; 62/457.4, 457.7, 459
See application file for complete search history.

(56) References Cited

U.S. PATENT DOCUMENTS 2,645,332 A * 7/1953 Martin et al. ..... 206/545
3,988,909 A * 11/1976 Catapano ..... 70/63
4,030,426 A 6/1977 Lyons
4,145,978 A * 3/1979 Johnson et al. ..... 109/59 R
4,194,647 A * 3/1980 Spurrier ..... 221/97
4,474,116 A * 10/1984 Castenada et al. ..... 109/51
4,506,769 A * 3/1985 Franco et al. ..... 190/108
4,539,828 A 9/1985 Teleky
4,664,041 A 5/1987 Wood
4,667,491 A * 5/1987 Lokken et al. ..... 70/63
4,673,117 A * 6/1987 Calton ..... 224/148.3
4,721,237 A * 1/1988 Leslie ..... 224/148.3
4,799,370 A 1/1989 Cooper
4,899,904 A * 2/1990 Dooley et al. ..... 220/592.16
4,916,923 A * 4/1990 Adams et al. ..... 62/457.1
5,235,920 A 8/1993 Hector
5,403,095 A * 4/1995 Melk ..... 383/110
5,493,874 A * 2/1996 Landgrebe ..... 62/457.2
5,501,338 A * 3/1996 Preston ..... 206/545
5,595,073 A * 1/1997 Sullivan ..... 70/18
5,758,513 A * 6/1998 Smith ..... 62/457.5
5,884,989 A 3/1999 Truelove
5,934,499 A 8/1999 van der Hoven
6,067,813 A * 5/2000 Smith ..... 62/371
6,234,677 B1 * 5/2001 Mogil ..... 383/110
6,247,328 B1 * 6/2001 Mogil ..... 62/457.2
6,276,162 B1 * 8/2001 Schemel ..... 62/457.2
6,490,893 B1 12/2002 Benion
6,604,390 B1 * 8/2003 Nooner ..... 70/63
6,658,903 B1 * 12/2003 McShane et al. ..... 70/63
7,162,890 B2 * 1/2007 Mogil et al. ..... 62/457.7

(Continued)

*Primary Examiner*—Suzanne Dino Barrett
(74) *Attorney, Agent, or Firm*—Robert T. Johnson

(57) ABSTRACT

Portable locker apparatus is disclosed comprising three parts or components which includes a locker body formed of plastic material a tray for holding beverage cans placed horizontally on wave form ridges in the tray, and a carrying bag fitting around the portable locker apparatus, and in this first embodiment a cable fitting in slots in the portable locker apparatus with a padlock connecting eyelets on the cable ends and to anchor the whole assembly as needed. The second embodiment excludes the cable and slots but includes all other components of the portable locker apparatus, beverage tray and carrying bag.

2 Claims, 15 Drawing Sheets

U.S. PATENT DOCUMENTS

Figure 1:
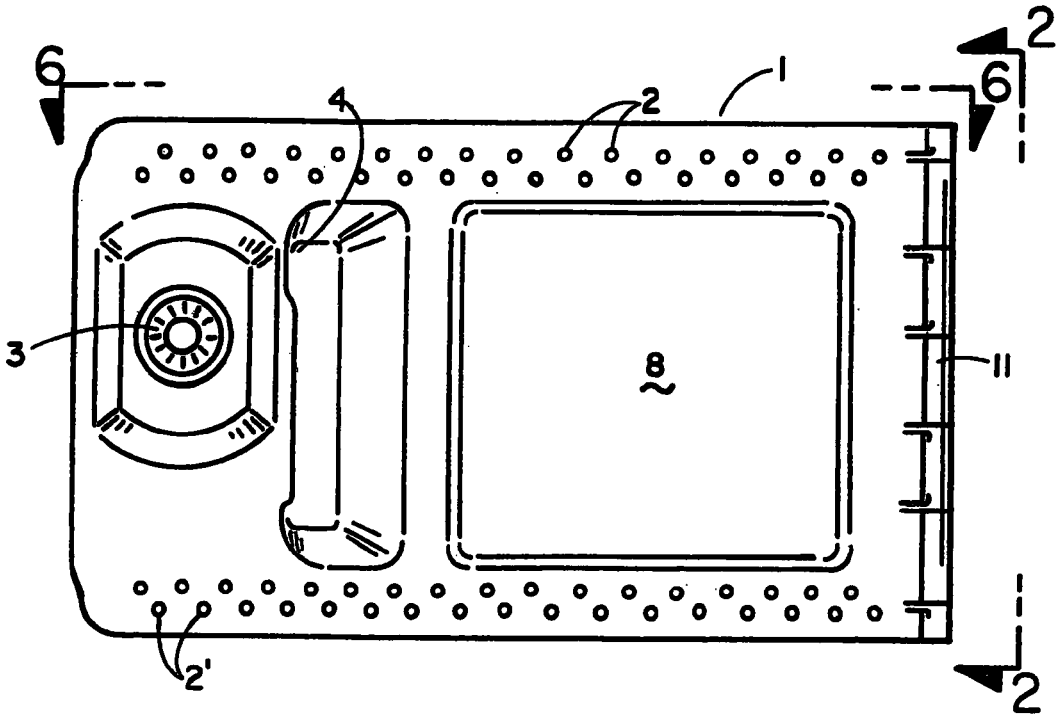

2002/0148395 A1* 10/2002 Judge ..... 109/52
2004/0045329 A1* 3/2004 Farnham et al. ..... 70/63
2004/0154359 A1* 8/2004 Jakubowski ..... 70/63
2005/0199628 A1* 9/2005 Van Handel et al. ..... 220/315
2006/0230794 A1* 10/2006 Liu ..... 70/63

* cited by examiner

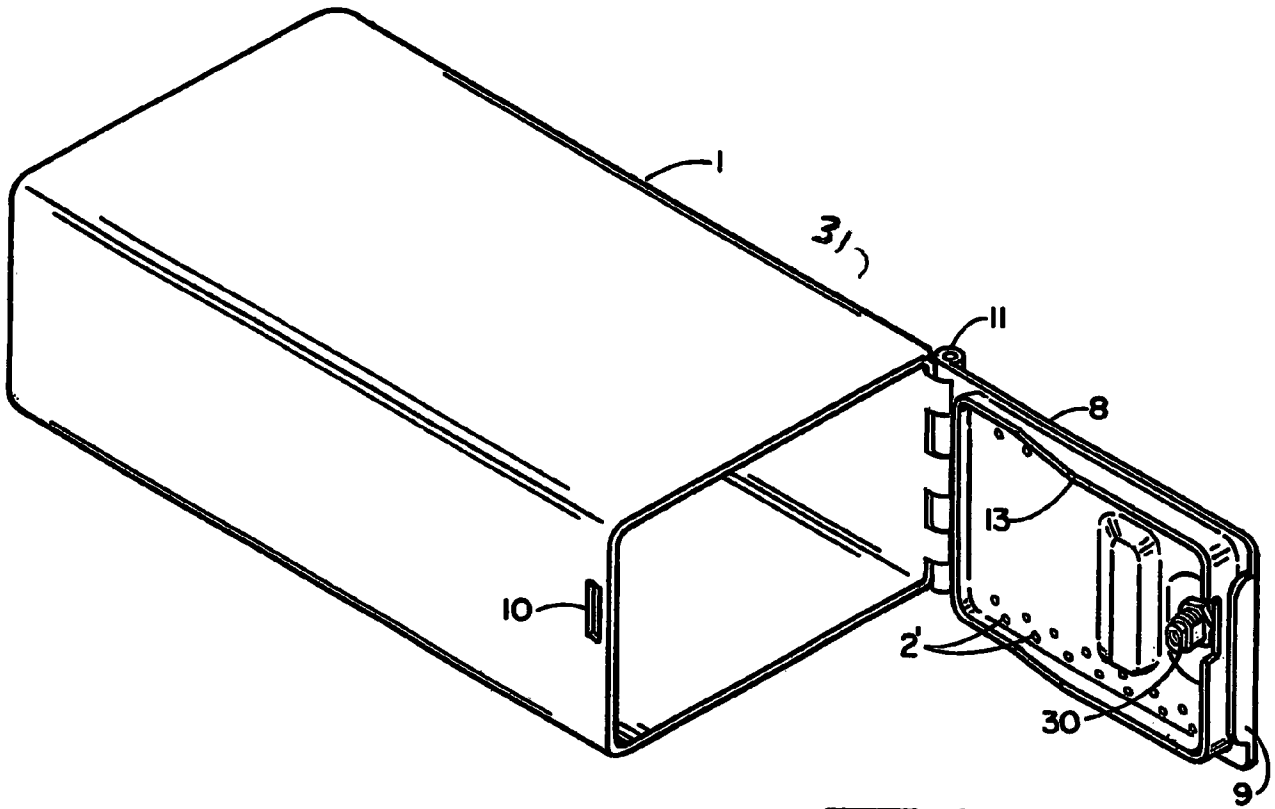
FIG 6
FIG 7
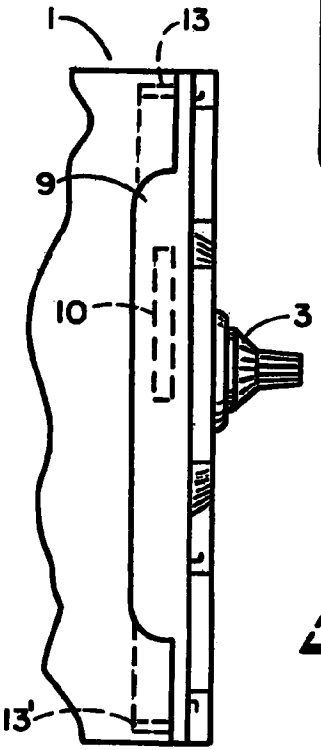

PORTABLE LOCKER APPARATUS

CROSS REFERENCE TO RELATED APPLICATION

This application claims the benefit of priority to U.S. Provisional Application No. 60/817,162, filed Jun. 29, 2006, which is hereby incorporated by reference in its entirety.

BACKGROUND OF THE INVENTION

Often it is desirable to carry or stow needed equipment, food, beverages or personal belongings in a lockable portable container and to be locked or unlocked by the owner, as needed or required

SUMMARY OF THE INVENTION

This invention discloses and claims portable locker apparatus which may be further described as portable locker apparatus and is an assembly of three components which includes a lockable locker body, a slidable tray fitting inside of the lockable locker body for canned food or beverages loaded on to the slidable tray and the loaded slidable tray fitting inside of the lockable locker body and this whole assembly may be placed in a refrigerator and the door of the lockable locker body locked, and further the whole assembly of the loaded slidable tray fitting inside of the locked locker body placed in a refrigerator and locked onto a tray of the refrigerator as a first embodiment, by inserting a cable loop through a double slot at the rear floor of the locker and the ends of the cable loop locked together with a padlock, and the third component being a fabric carrying bag and placing the assembly of the locked portable locker body containing the loaded slidable tray fitting into the fabric carrying bag, and the carrying bag having an opening for the cable loop extending from the rear floor of the portable locker through the opening of the carrying bag and the cable loop extending further to lock the total three component portable locker assembly to a suitable anchor to prevent pilferage of the total assembly. The second embodiment to omit slots, cable and padlock, for locking the portable locker apparatus.

The portable locker body apparatus and slidable tray assembly have many vents to hasten the cooling of the contents of food or beverages when the assembly is placed in a refrigerator. There is room in this portable locker apparatus to include cold ice bags as needed, and as an alternate, this apparatus of a portable locker may be used for warm foods if so desired.

The fabric carrying bag may include insulation to keep the contents cool, or to keep the contents warm if so desired

BACKGROUND ART

Background art is listed below, and it is to be pointed out that none of the cited patents, individually would anticipate, or collectively make obvious this present invention.

U.S. Pat. No. 4,030,426 for TRAV-L-SAFE

U.S. Pat. No. 4,539,828 for SECURITY LOCK BOX

U.S. Pat. No. 4,664,041 for BEACH LOCKER

U.S. Pat. No. 4,799,370 for VIDEOCASSETTE LOCK BOX

U.S. Pat. No. 5,235,920 for SECURITY LOCK BOX

U.S. Pat. No. 5,884,989 for HANDGUN SECURITY LOCK BOX

U.S. Pat. No. 5,934,499 for LOCKER BOX

U.S. Pat. No. 6,490,893 for PORTABLE LOCK BOX

| FIG. NO. | DESCRIPTION |
|---|---|
| 1. | Front elevation view of portable locker apparatus |
| 2. | Elevation view of left side of portable locker apparatus. |
| 3. | Elevation view of rear side of portable locker, apparatus. |
| 4. | Elevation view of right side of portable locker apparatus |
| 5. | Plan view of bottom of portable locker apparatus |
| 6. | Plan view of top of portable locker apparatus |
| 7. | Enlarged elevation view of door flap extending over lock pin slot. |
| 8. | Isometric view of portable locker apparatus |
| 9. | Isometric view of locker with door open. |
| 10. | Front end elevation view of removable tray fitting in portable locker. |
| 11. | Cross section view of tray. |
| 12. | Plan view of removable tray. |
| 13. | Side elevation view of tray. |
| 14. | Plan view of tray bottom outer surface. |
| 15. | Isometric view of locker carry bag, showing lock and cable with front door flap open. |
| 16. | Isometric view of locker carry bag with door flap open. |
| 17. | Front elevation view of locker in carrying bag with front flap open. |
| 18. | Front elevation view of locker in carrying bag with front flap zippered shut. |
| 19. | Portable locker apparatus attached to shelf wires of refrigerator |
| 20 | Elevation view of rear side of locker apparatus. |
| 21 | Plan view of bottom of portable locker apparatus |
| 22 | Isometric view of portable locker apparatus carry bag. |

| LEGEND NO. | DESCRIPTION |
|---|---|
| 1. | Portable locker apparatus body. |
| 2, 2'. | Vents in door of locker. |
| 3. | Combination dial for door lock. |
| 4. | Vents in door of locker. |
| 5. | Vents in top edge of rear of locker. |
| 6, 6', 6", 6''' | Slots in edges of rear side of portable locker. |
| 7, 7' | Segments between slots 6, 6' and 6", 6''' |
| 8. | Door of portable locker body. |
| 9. | Door flap over slot 10 in portable locker body. |
| 10. | Slot for combination lock bolt. |
| 11. | Hinge for door of portable lockerbody. |
| 12. | Perforated vent area in bottom of beverage holding tray. |
| 13, 13' | Inner/outer ridge on door 8 of portable locker body. |
| 14. | Wave form ridges on tray for holding beverage cans. |
| 15. | Cable for locking or anchoring portable locker. |
| 16. | Beverage cans loaded on tray for holding cans. |
| 17. | Beverage holding tray. |
| 18. | Padlock for locking cable eyes together. |
| 19. | Runners on underside bottom of beverage tray |
| 20. | Closure flap at rear panel of carrying bag. |
| 21. | Velcro loops. |
| 22. | Velcro hooks. |
| 23. | Zipper on front panel of carrying bag. |
| 24. | Rear panel of locker carrying bag. |
| 25. | Carrying bag for locker. |
| 26. | Handle straps attached to carrying bag. |
| 27. | Carrying bag closing flap panel. |
| 28, 28' | Eyes in cable ends. |
| 29 | Refrigerator wire shelf. |
| 30 | Door lock bolt. |
| 31 | Portable locker apparatus. |

DETAILED DESCRIPTION OF THE INVENTION

Portable locker apparatus is useful for carrying hot or cold food. cold beverages or other items to job sites, work sites or fun sites and the locker to be locked to prevent pilferage, and further the locker to be locked on to the site to prevent theft of the portable locker.

Figure 3:
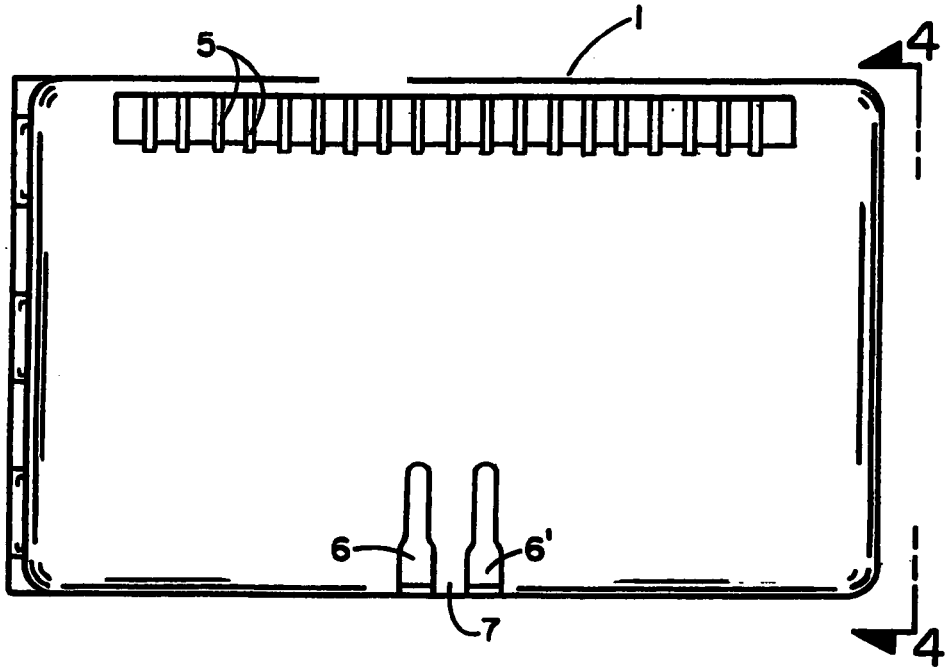
Figures 2, 4:
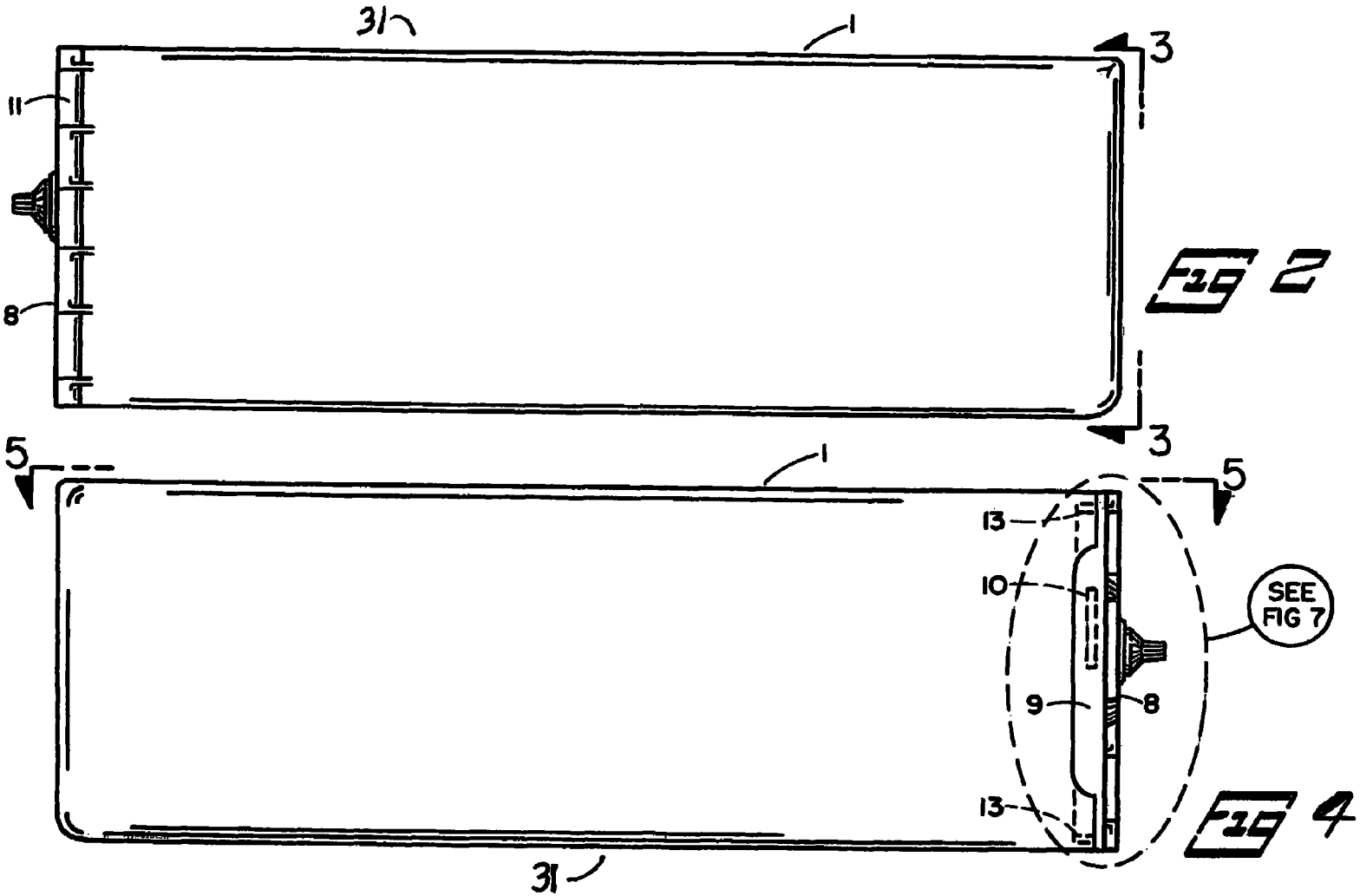
Figure 8:
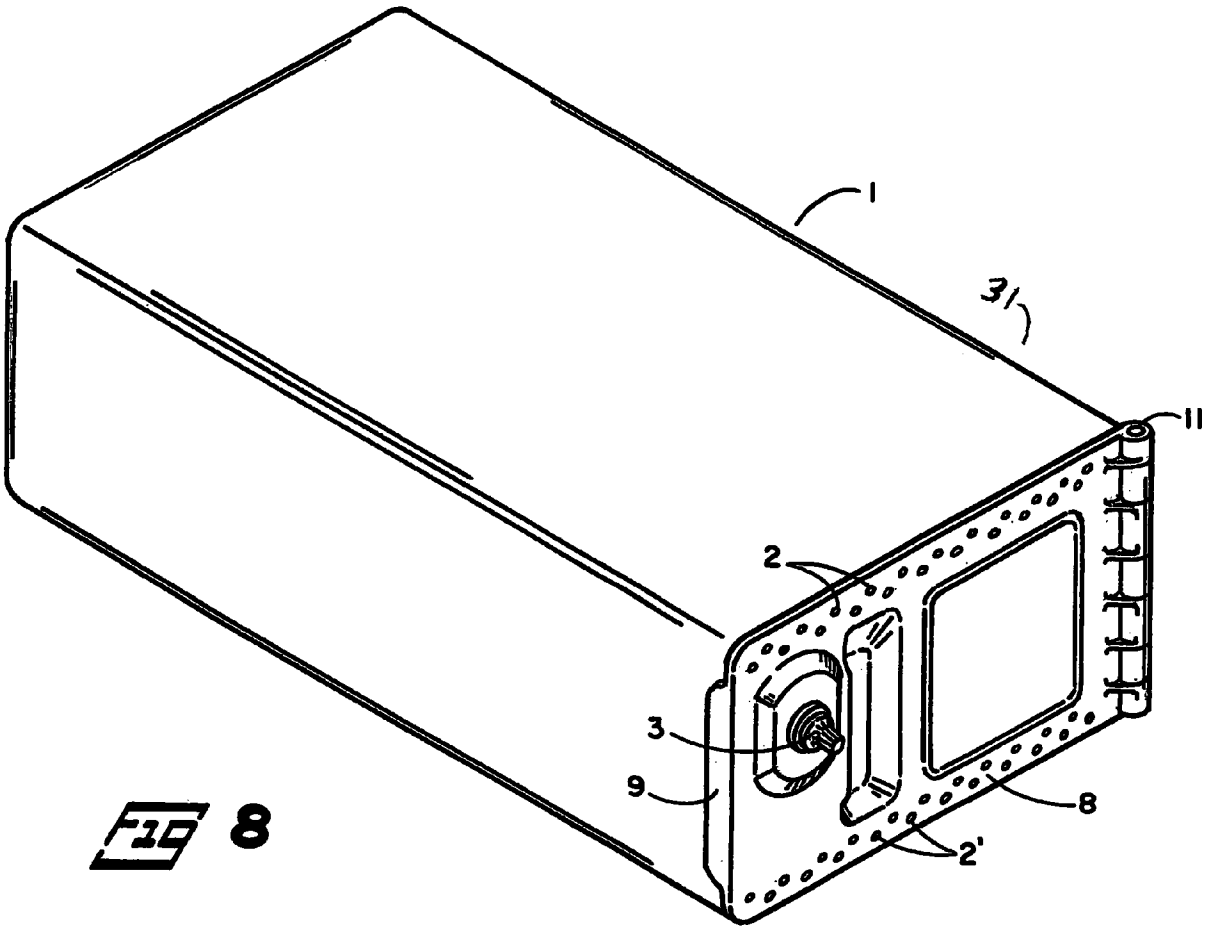

The portable locker apparatus body 1, shown in FIG. 8 in isometric view, and FIG. 1 is a front elevation view of the portable locker apparatus body 1, showing the door 8 of the portable locker body 1, and the door 8 hung on hinge 11 and combination dial 3 for door lock, vents 2, 2' in top edge and bottom edge door of locker. Vents 4 are shown adjacent to the combination dial 3 for the door lock FIG. 2 is elevation view of left side of the portable locker body 1, showing hinge 11 for mounting of door 8 of the portable locker body 1. FIG. 3 is an elevation view of rear or back side of portable locker apparatus body 1, and vent slots 5 in door 1 on front of the portable locker apparatus body 1, and slots 6, 6' in bottom of rear wall of the portable locker 1, with a segment 7 between the slots 6, 6' for threading cable 15 through slots 6, 6' and around segment 7 between the slots 6, 6' with a padlock 18 attached to the eyes 28, 28' in the cable ends. (see FIG. 19). Further reference is made to FIG. 19, to show alternate location for locking the portable locker apparatus 31 showing slots 6", 6'" slots in top rim of the rear of the portable locker, and segment 7' between slots 6" and 6'".

FIG. 4 is an elevation view of right side of portable locker apparatus body 1, showing door edge 9 over slot 10 which receives the locking bolt of the door lock activated by combination dial 3. The door edge 9 is perpendicular to door 8 of the portable locker apparatus body 1. Also shown in this FIG. 4 is inner door edge 13 extending inside the edges of the portable locker 1 opening. This is to reinforce the edges of the opening of the portable locker apparatus 1, and work in conjunction with the edge of the door 8 of the portable locker apparatus body 1, which edge overlaps the outside edges of the front opening of the portable locker apparatus 1.

Figure 5:
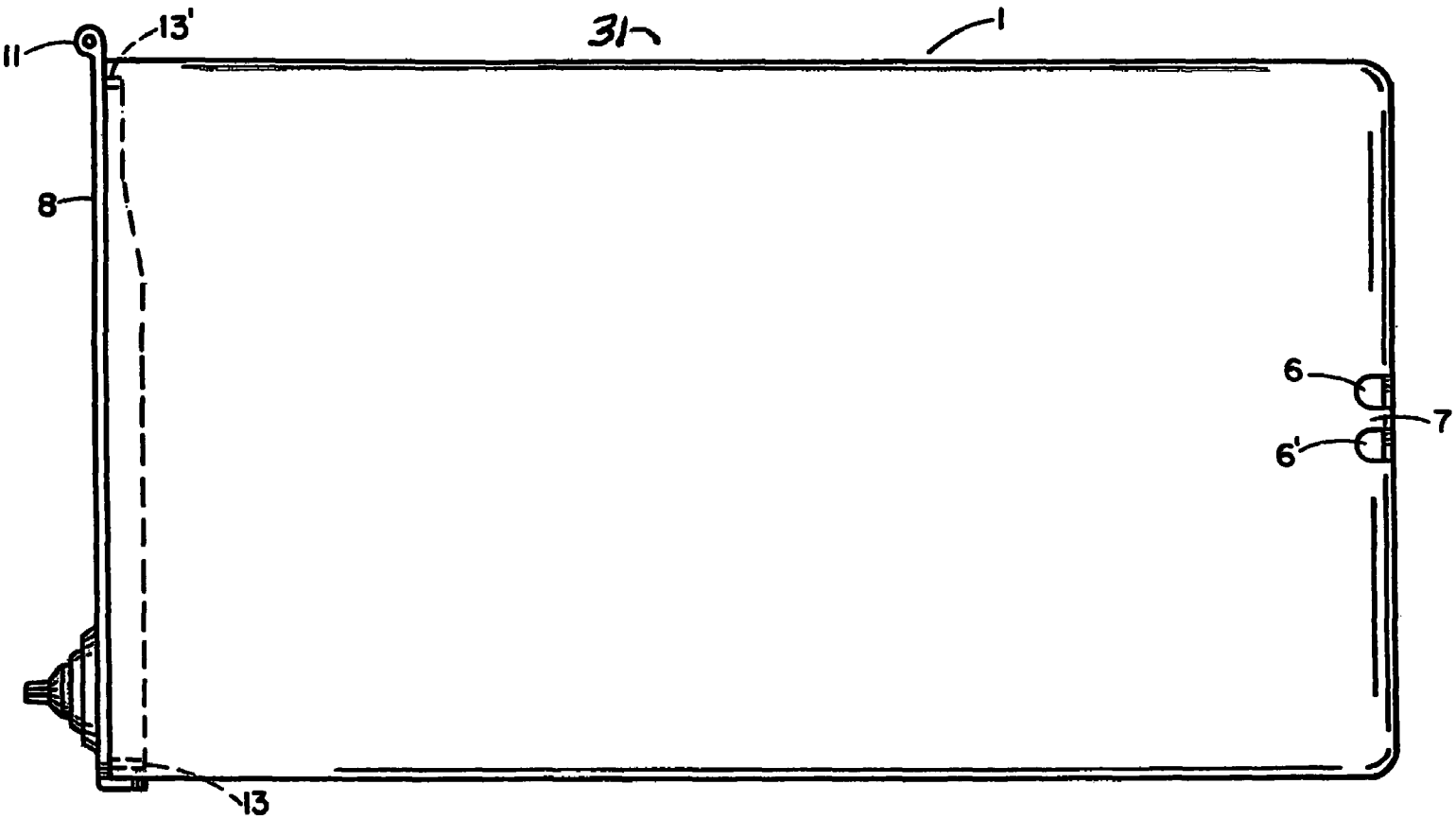

FIG. 3 is an elevation view of the back or rear side of the portable locker apparatus body body 1, showing slots 6, 6' for threading cable 15 for locking the portable locker apparatus 1, and these slots extend over into the bottom of the portable locker as shown in FIG. 5.

FIG. 6 is a top plan view of the portable locker apparatus 1, showing the door 8, hinge 11 for door of the portable locker 1 and rim 13 extending around the inner periphery of the door edge and the edge of the opening of the portable locker apparatus 1, edge.

Figure 9:
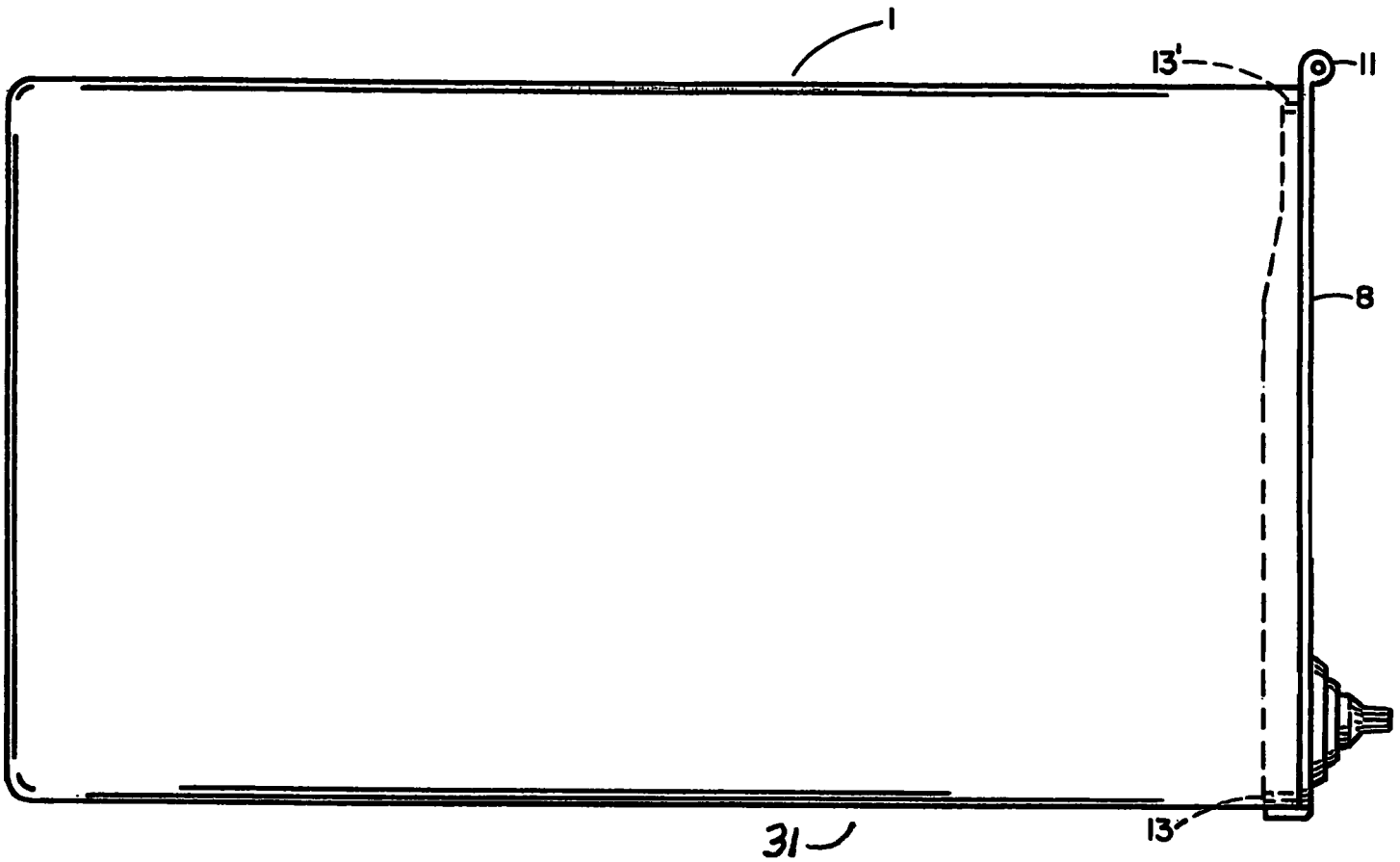

FIG. 7 is an enlarged section of FIG. 4, showing combination dial 3 for the door lock and door edge ear 9 extending over slot 10 in portable locker apparatus body 31. The slot 10 is shown in FIGS. 4 and 7 by phantom lines with legend 13 showing edge of the door 8 extending over the outer edge of the open end of the portable locker, and inner ridge 13 of door 8 extending over the inner edges of the open end edges of the portable locker apparatus body 31. Door lock bolt 30, is shown in FIG. 9.

FIG. 8 is isometric view of portable locker apparatus 31, with the door 8 of locker in closed position. FIG. 9 is isometric view of portable locker apparatus body 31, and portable locker apparatus 1 with door 8 of locker in open position.

Figure 11:
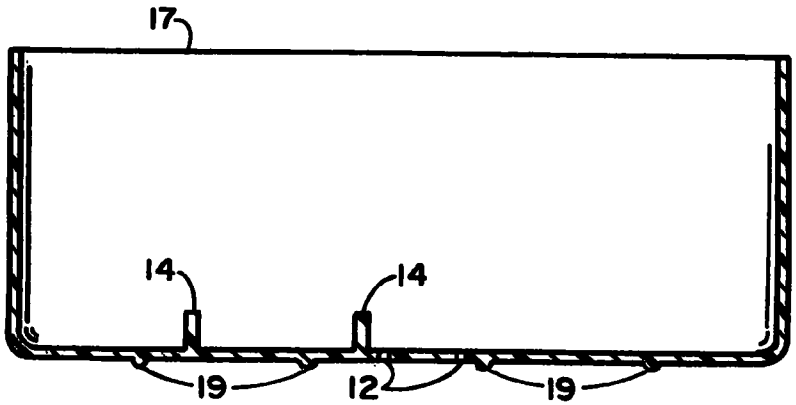
Figure 10:
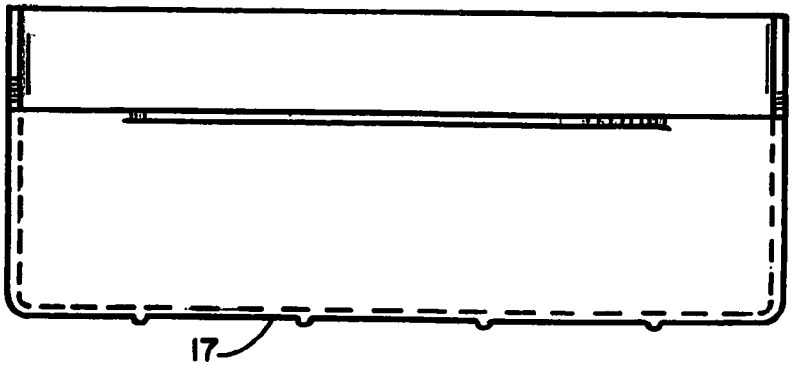
Figure 12:
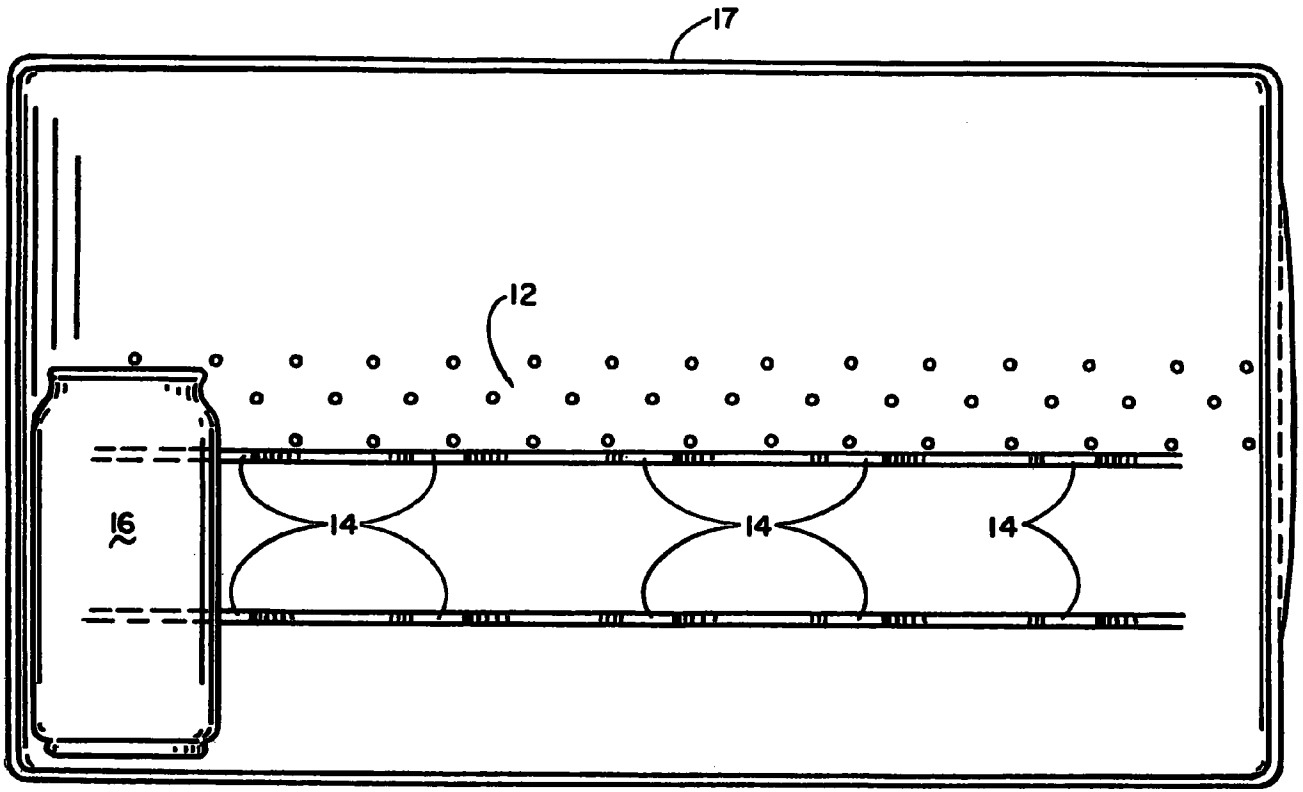

The whole assembly of the portable locker apparatus 1 is to include portable locker apparatus body 31, a tray, or beverage holding tray 17 shown in FIG. 10, which is a front elevation view thereof and showing phantom wave form ridges in the tray 17, and extending the length of the tray as shown in FIG. 12. FIG. 11 is a cross section view of FIG. 10 showing wave form ridges 14 in the beverage tray 17, and runners 19 on the under side bottom of the beverage tray 17, and perforated area 12, extending the length of tray 17.

The wave form may be further described as a crest and trough.

FIG. 12 is a plan view of the tray 17, showing the wave form ridges 14 extending length wise in the tray 17 and a beverage can 16 loaded on a trough, and perforations 12 on the bottom of and extending the length of tray 17.

Figure 13:
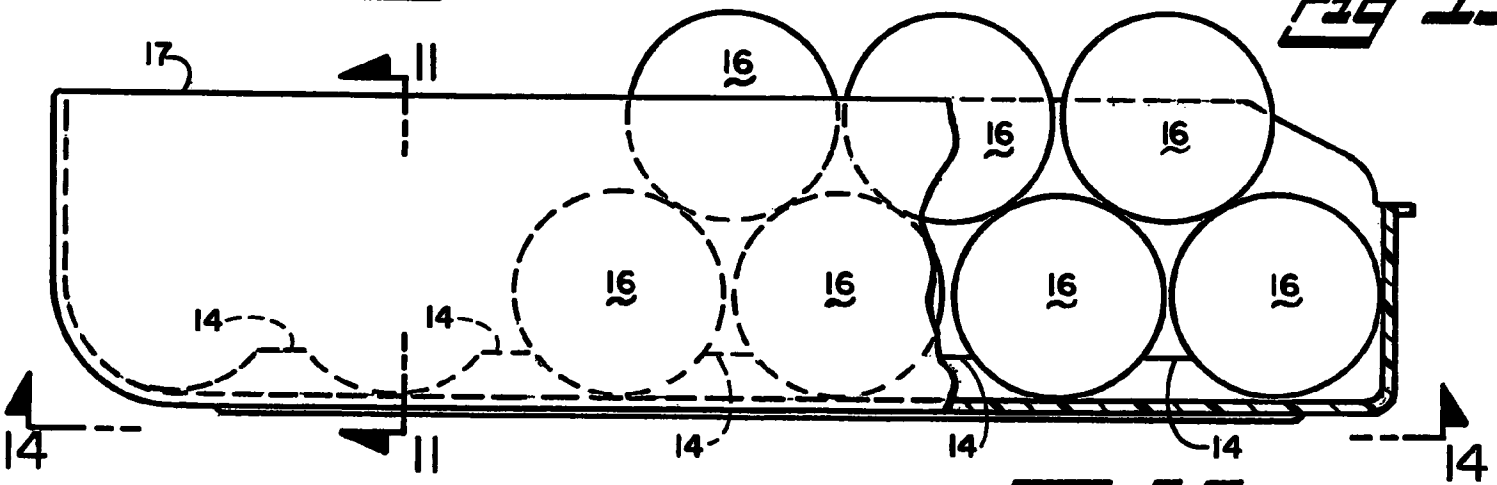

FIG. 13 is a side elevation view of tray 17, showing wave form ridges 14 in the tray 17 for holding beverage cans 16, shown loaded in a double layer.

Figure 14:
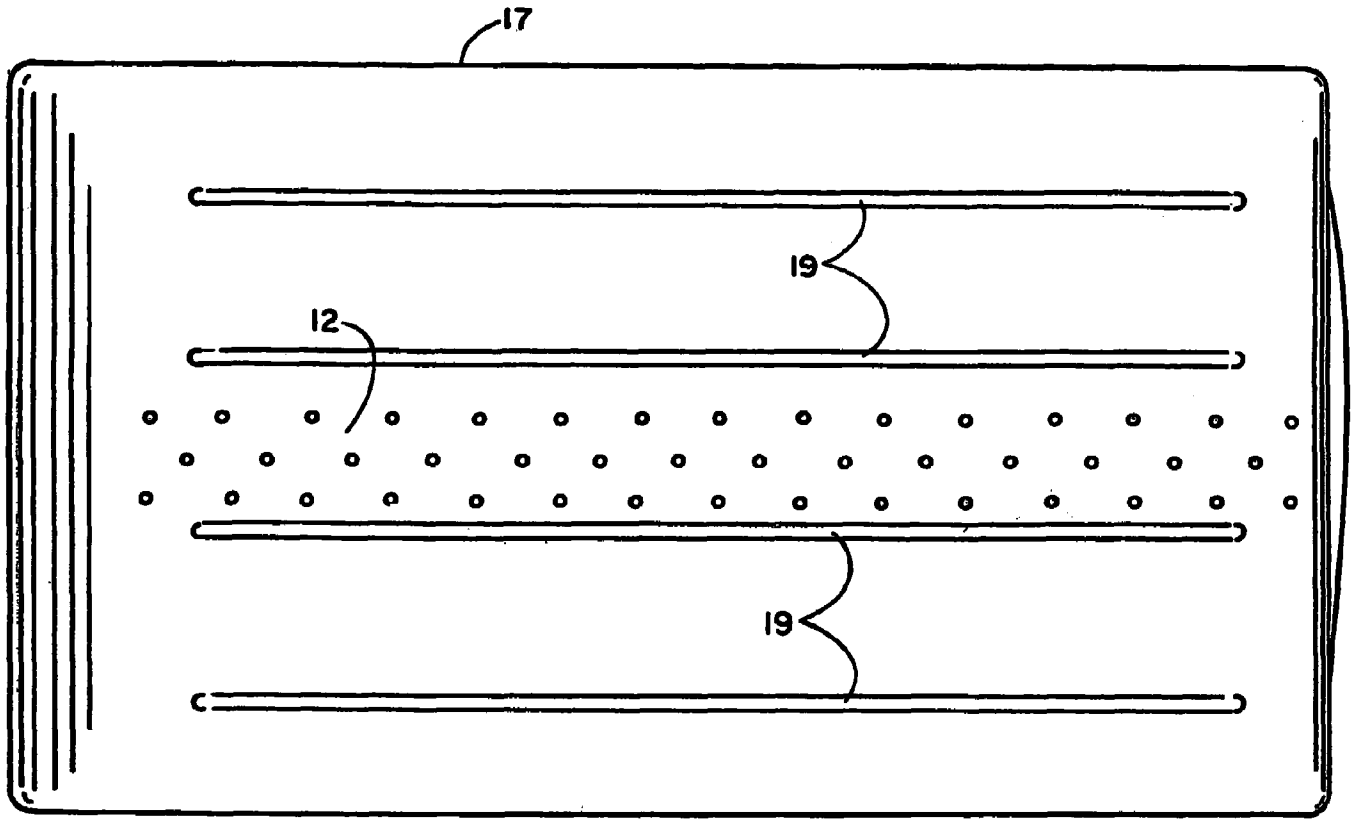

FIG. 14 is a bottom plan view showing runners 19 on underside bottom of beverage tray 17 and perforated vent area 12 in the bottom of tray 17.

Figure 15:
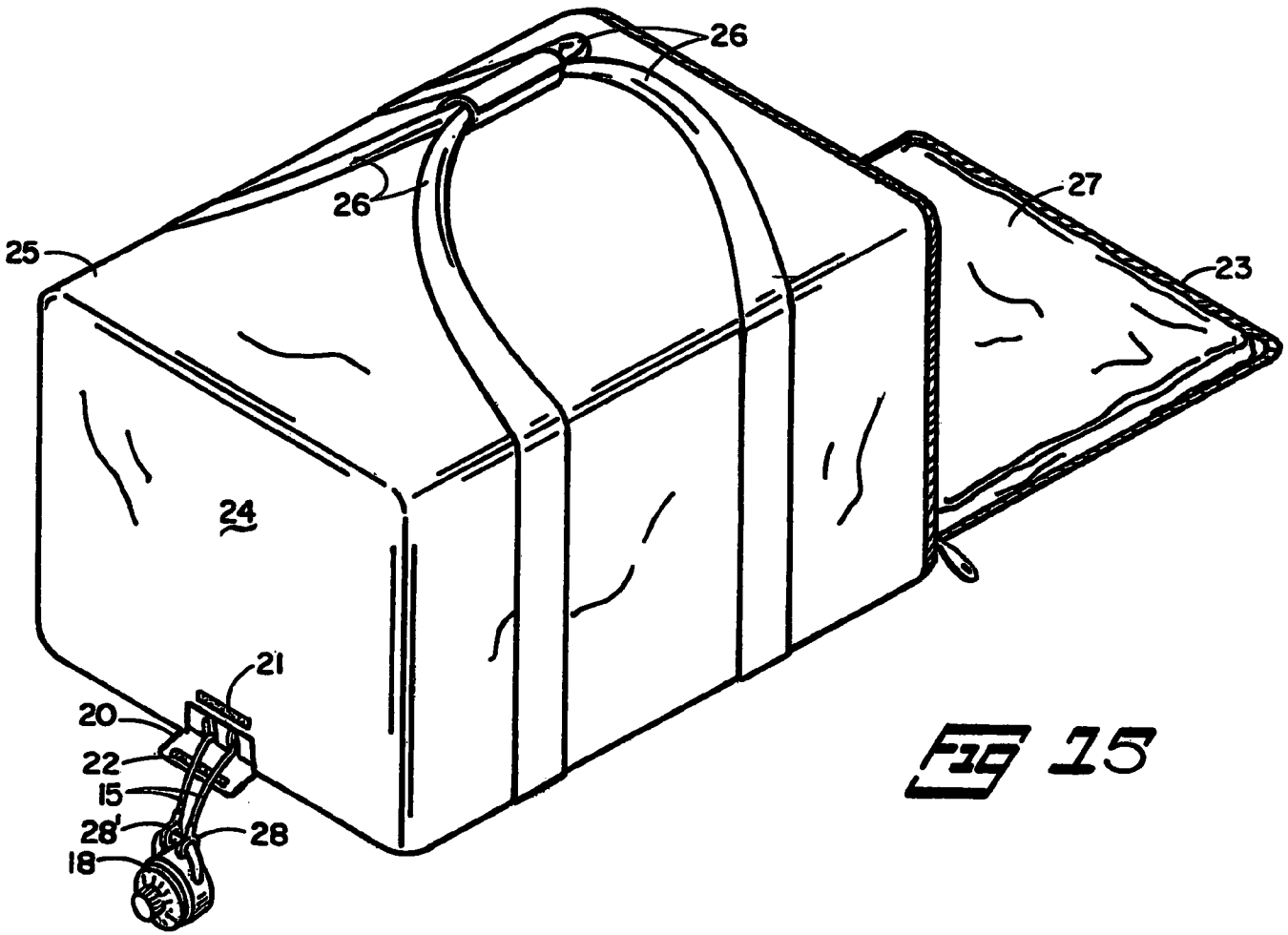

FIG. 15 is a flexible cloth insulating carrying bag 25 for portable locker apparatus 31, and having handle straps 26 on the bag, a carrying bag closing flap 27, with zippers 23 on the closing flap 27 and the zipper 23 meshing with zipper 23' on the opening of the carrying bag. At the rear of the carrying bag 25 is panel 24, of portable locker carrying bag 25 having a carrying bag closing flap 20, there is a lock opening flap 20, having a Velcro hooks 22, to mesh with Velcro loops 21 mounted on the rear panel bottom of the carrying bag 25. This opening and closing flap 20 allows attaching the cable 15 for locking the portable locker 1 in the carrying bag 25 and a padlock 18 attached to the eyes 28, 28' in the cable ends.

Figure 16:
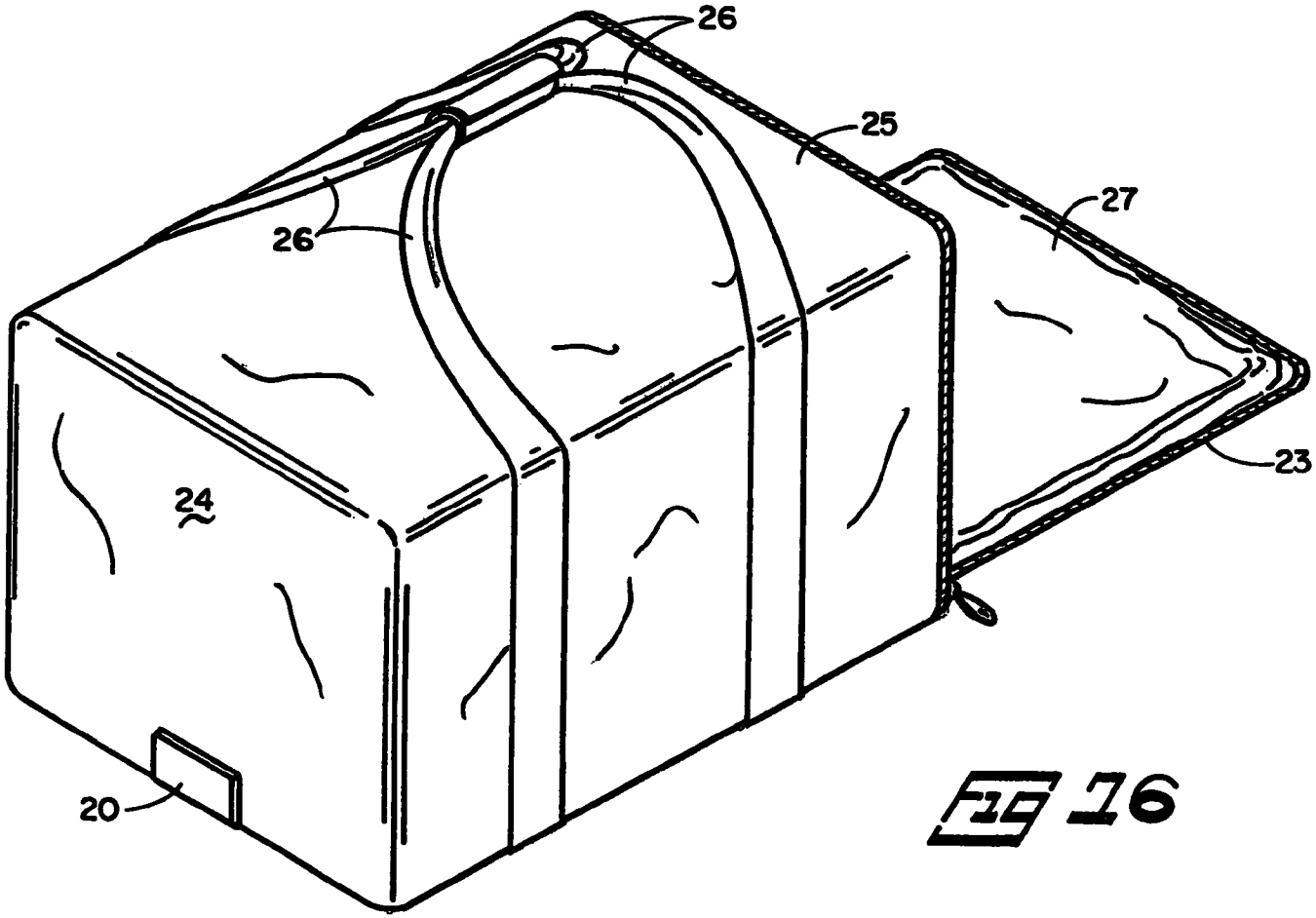

FIG. 16 shows the carrying bag 25, and rear panel 24, of carrying bag 25, with rear lock opening/closing flap 20 in closed position.

Figure 17:
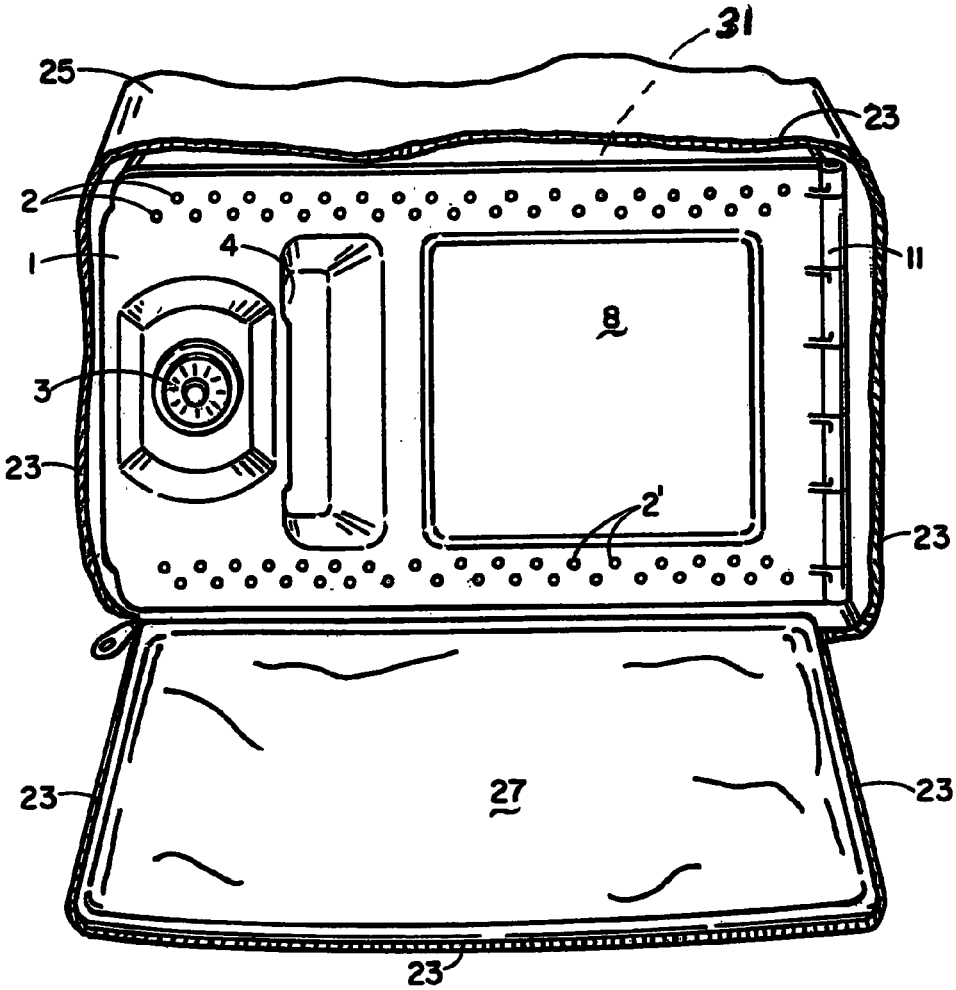
Figure 18:
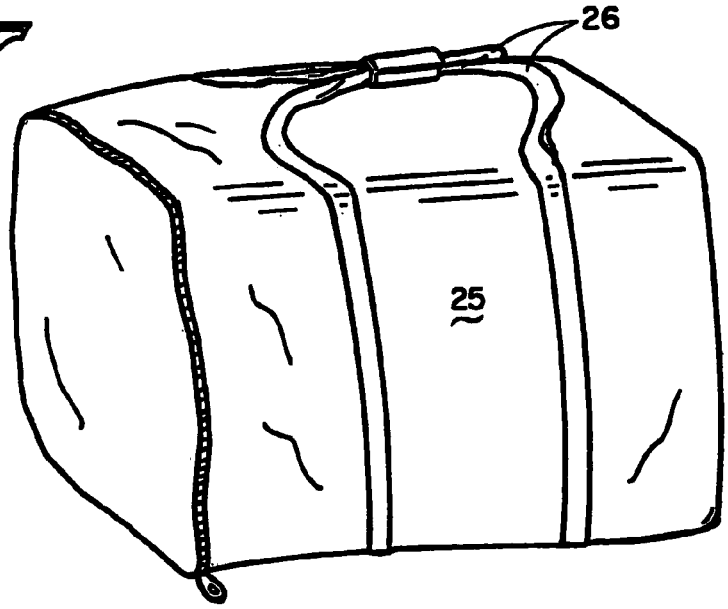

FIG. 17 is a front perspective view showing in particular the portable locker apparatus 31 in carrying bag 25, and carrying bag opening/closing flap 27 in open position FIG. 18 is a perspective view of the portable locker apparatus 31 in the closed carrying bag 25.

Figure 19:
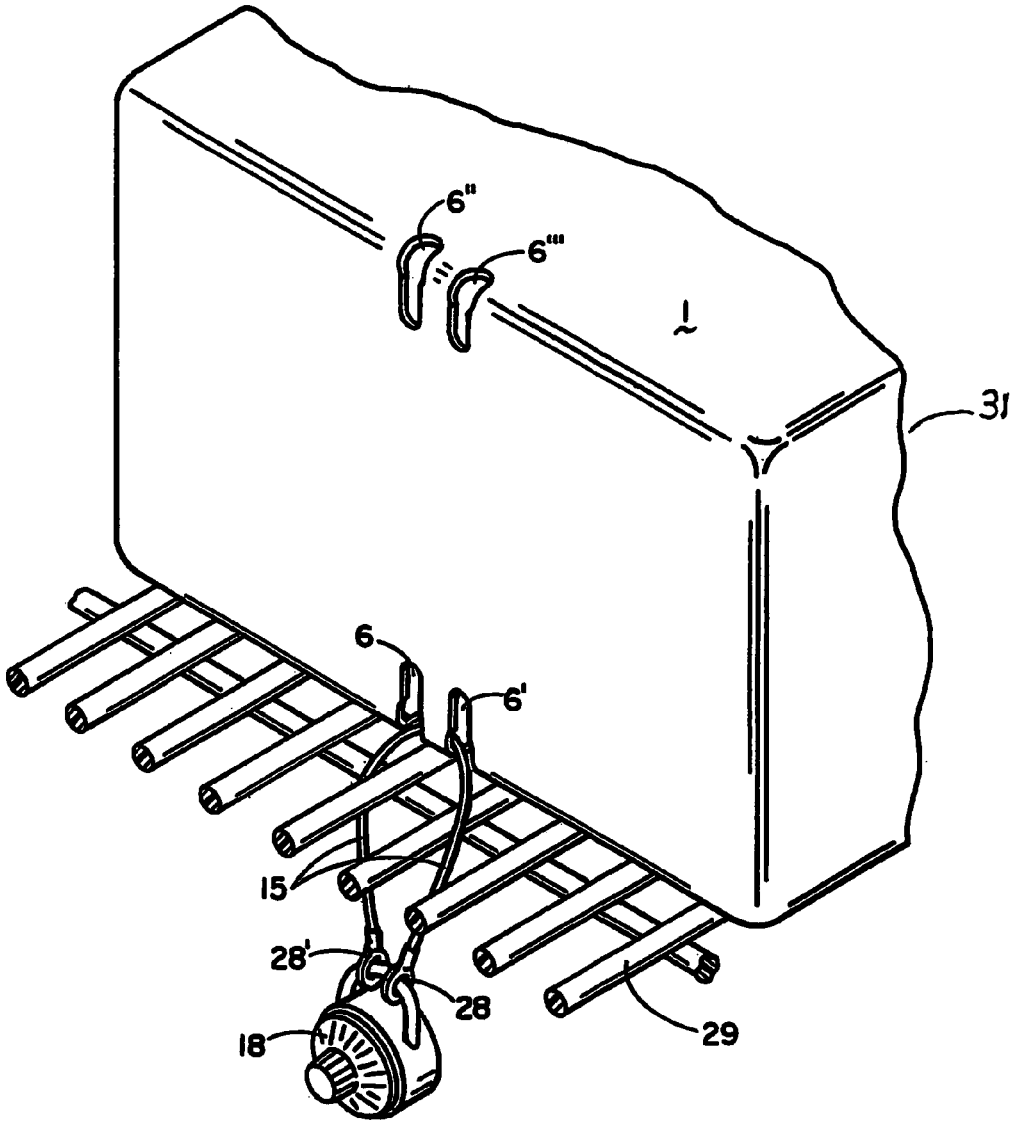

FIG. 19 is a pictorial of portable locker 31, in a refrigerator, and the locker locked onto the wire shelf 29 of the refrigerator via the cable 15, and the eyes 28, 28' of the cable connected by a padlock 18.

Figure 20:
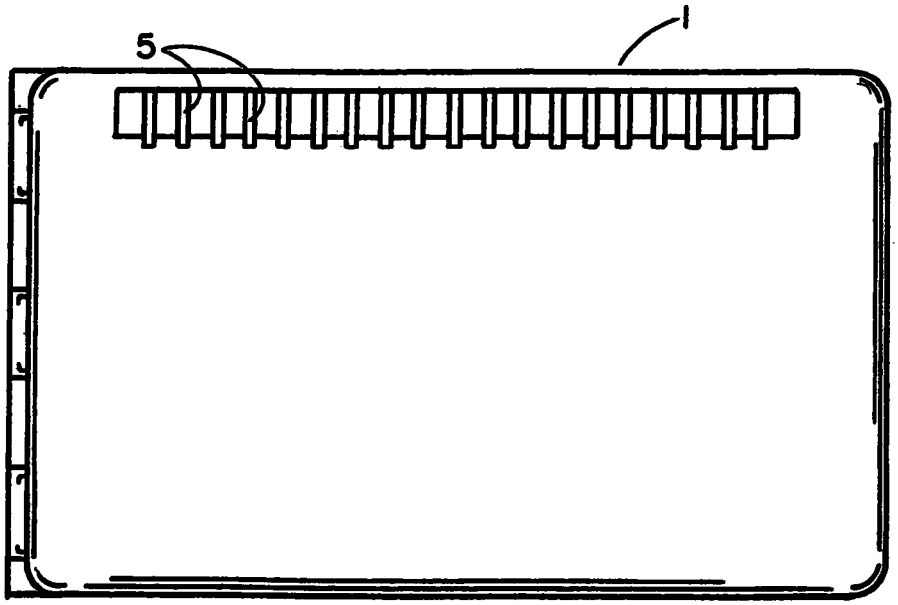
Figure 21:
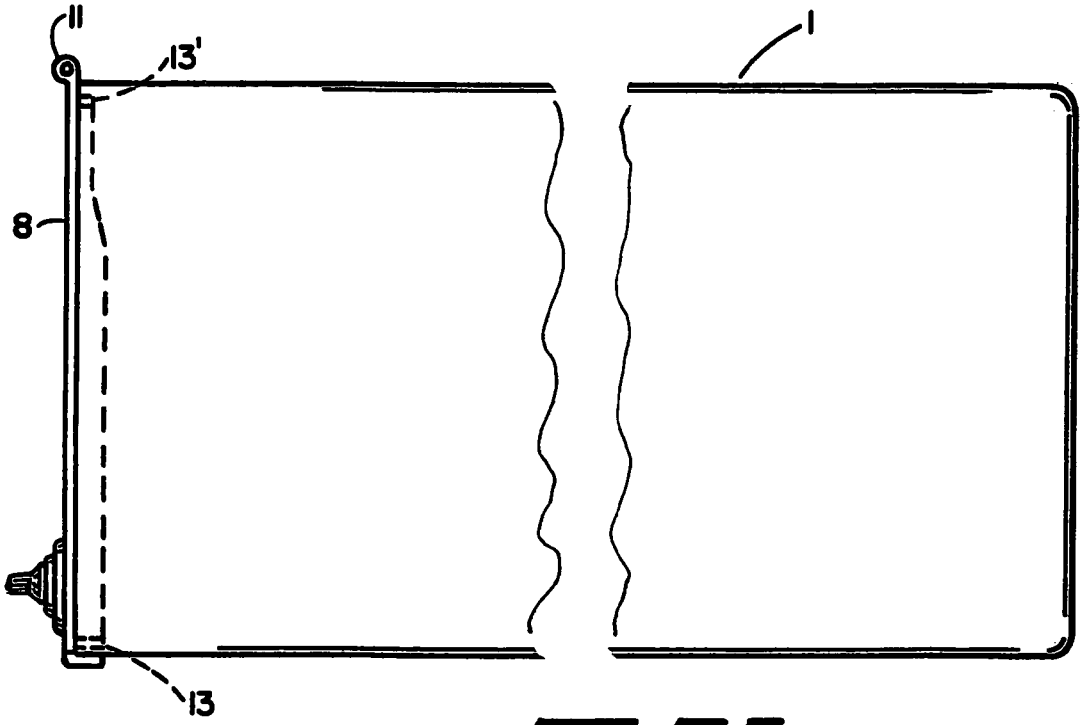
Figure 22:
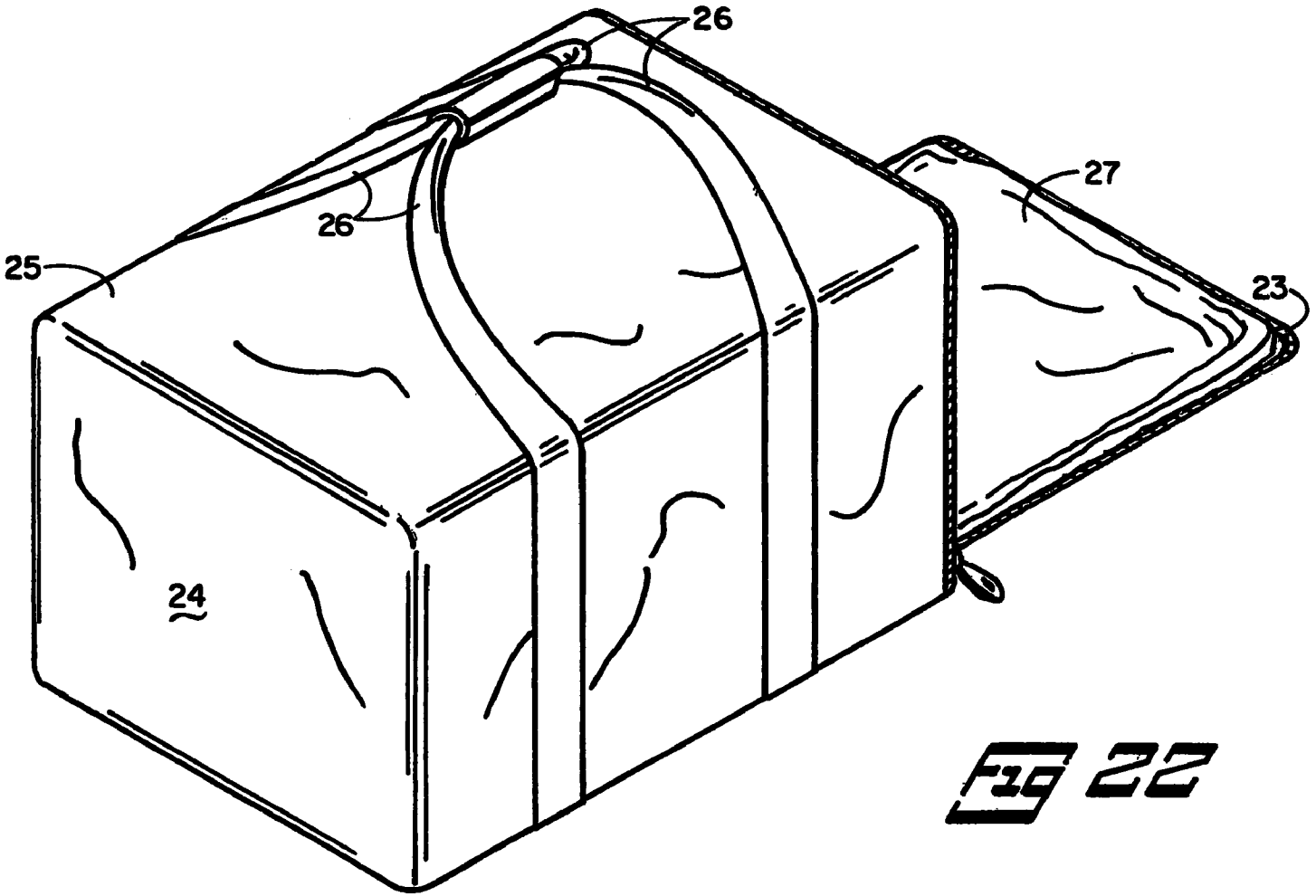

The second embodiment of this invention is shown in FIGS. 20, 21, and 22, wherein FIG. 20 is an elevation view of the rear side of portable locker apparatus showing an alternate to FIG. 3, wherein slots 6, 6' as shown in FIG. 3 are deleted. FIG. 21 is a plan view of bottom of portable locker apparatus 31, derived from FIG. 5, but slots 6, 6' are omitted from the plan view of bottom of portable locker apparatus and is an alternate to FIG. 5, and is a second embodiment. FIG. 22 is an isometric view of portable locker apparatus carrying bag, derived from FIG. 16, but deleting closure flap 20 at the rear of carrying bag 25, for portable locker apparatus 31. The first embodiment of this invention discloses and claims provisions for locking the portable locker apparatus by having slots 6, 6', 6", 6'" in the portable locker apparatus, and closure flap 20 at the rear of carrying bag 25. On referring to the above FIG. 21, this is a compressed version of FIG. 5, to show deletion of slots 6, 6', 6" and 6'" in edges of rear side of portable locker apparatus body 1, as the second embodiment of this invention.

The portable locker apparatus body 1, door 8 of portable locker apparatus 31, and beverage holder tray 17 of this invention, apart from the carrying bag, are formed of plastic, selected from polyethylene, polystyrene, nylon, polyvinyl, polycarbonate or ABS, and preferably including reinforcing fibers such as glass fibers for added rigidity.

The carrying bag 25 is of fabric, and may include insulation to be an insulated carrying bag to help maintain either cold or heat in the portable locker apparatus 31, enclosed in the carrying bag 25.

The first embodiment of this invention includes FIGS. 3, 5, 15, 16, and 19, and includes legends 6, 6', 7, 15, 18, 20, 21, 22, 28, and 28', while the second embodiment is shown in FIGS.

20, 21, and 22. FIG. 3, the, first embodiment, shows legends 6, 6', 7 and FIG. 20, the second embodiment, without the legends 6, 6', and 7 is derived from FIG. 3. FIG. 5, the first embodiment, shows legends 6, 6', and 7, and FIG. 21, the second embodiment, without the legends, is derived from first embodiment FIG. 5. FIG. 15, the first embodiment, shows legends 15, 18 20, 21, 22, 28, and 28' and FIG. 22, the second embodiment, is derived from FIG. 15.

We claim:

1. A portable locker apparatus having components comprising:

a—portable locker apparatus body, b—a beverage holding tray fitting inside of said portable locker body, c—a hinged door mounted on open end of said portable locker body, d—a combination dial lock mounted on said hinged door, e—slots in bottom of rear wall of said portable locker body, f—a carrying bag fitting around said portable locker body and said beverage tray fitting inside of said portable locker body, g—handle straps attached to said carrying bag, h—said carrying bag having a zipper closing flap panel attached to open end of said carrying bag, i—a closure flap at rear panel of said carrying bag and said closure flap held in closed position by Velcro loops and hooks, j—cable threaded through said slots and a padlock for locking cable eyes together for anchoring said portable locker apparatus.

2. A portable locker apparatus of claim 1, further comprising:

a—said beverage holding tray having wave form ridges for holding beverage cans in horizontal position, b—said door lock mounted on said hinged door is combination dial lock, c—said beverage can holding tray, and said portable locker apparatus body formed of plastic selected from the group consisting of polyethylene, polystyrene, nylon, polyvinyl, polycarbonate or terpolymer ABS.

* * * * *